United States Patent [19]

Massey

[11] Patent Number: 4,634,394

[45] Date of Patent: Jan. 6, 1987

[54] PROJECTED TOY WITH ROTATABLE PADDLES

[76] Inventor: Jerald L. Massey, 140 Briardale Ave., Warner Robins, Ga. 31093

[21] Appl. No.: 801,229

[22] Filed: Nov. 25, 1985

[51] Int. Cl.[4] ..... A63H 27/12

[52] U.S. Cl. ..... 446/36; 446/45

[58] Field of Search ..... 446/45, 34, 36, 37, 446/66, 64, 61, 63, 62, 49, 54, 65, 68; 273/428; 244/138 A, 138 R

[56] References Cited

U.S. PATENT DOCUMENTS 2,548,748 4/1951 Stephan ..... 446/36 X 2,746,207 5/1956 Starkey ..... 446/45

3,113,398 12/1963 Merritt ..... 446/64 X 3,291,418 12/1966 Brunk et al. ..... 244/138 A X

*Primary Examiner*—Mickey Yu

*Attorney, Agent, or Firm*—James B. Middleton

[57] ABSTRACT

An aerial toy to be projected into the air, the toy having a rotor to slow the descent. The rotor is locked to be coplanar with the body while the toy is projected and during the ascent of the toy. At the apex of flight, the toy changes its attitude, the front pointing down, and a gravity operated driver releases the lock for the rotor. The rotor then rotates, providing enough aerodynamic drag to cause the toy to have a slow descent, and a soft landing.

6 Claims, 3 Drawing Figures

PROJECTED TOY WITH ROTATABLE PADDLES

INFORMATION DISCLOSURE STATEMENT

There are numerous forms of aerial toys, and the most common variety is a toy that has a sufficient air foil to accomplish a considerable amount of gliding through the air. Conventionally, whether the toy is launched by some projection means or is held aloft as a kite or the like, aerial toys are usually built for gliding.

Other aerial toys utilize a propeller, or movable wing principle, the propeller carrying the toy generally vertically into the air, then acting to slow the toy's descent.

There has been some use of rotary vanes, rotatable about a horizontal axis, but these have normally been used in kites or the like in order to provide a particular air flow pattern and achieve the desired lift.

SUMMARY OF THE INVENTION

This invention relates generally to aerial toys, and is more particularly concerned with a toy that is projected into the air at reasonably high speed, and floats downwardly slowly.

The present invention provides a toy comprising generally an air foil, rotor means being carried by the air foil, the rotor being lockable into position for streamlining the airfoil, and releasable so the rotor rotates to provide significant aerodynamic drag. In one embodiment of the invention, locking means is manually urged into locking position to secure the rotor in streamlined position with respect to the airfoil; and, when the toy reaches the apex of flight, a driver moves by gravity to release the locking means. The rotor is therefore free to rotate and produce sufficient drag that the toy floats back to earth.

BRIEF DESCRIPTION OF THE DRAWINGS

These and other features and advantages of the present invention will become apparent from the consideration of the following specification when taken in conjunction with the accompanying drawings in which.

DETAILED DESCRIPTION OF THE EMBODIMENT

Figure 1:
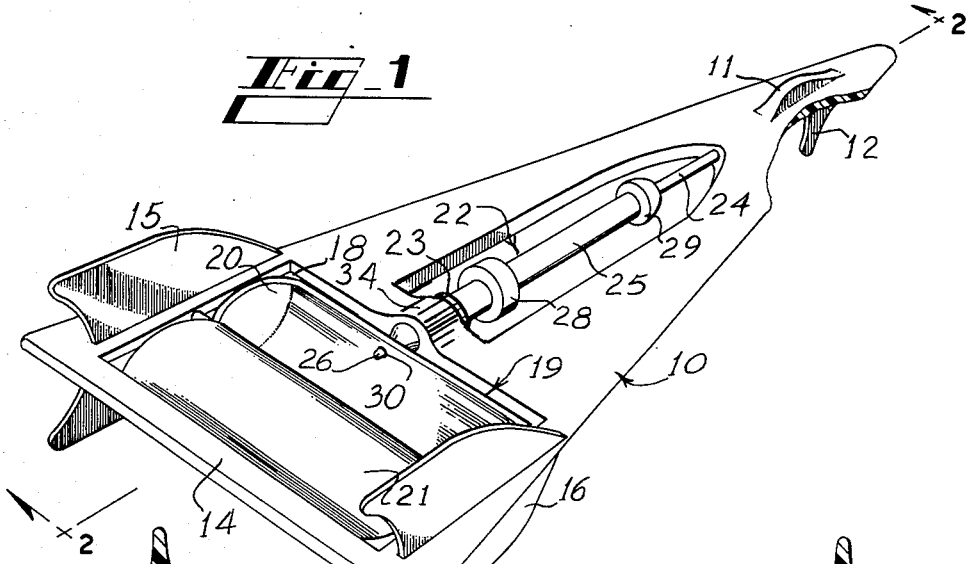
FIG. 1 is a perspective view, partially broken away, showing one form of toy made in accordance with the present invention.
Figure 3:
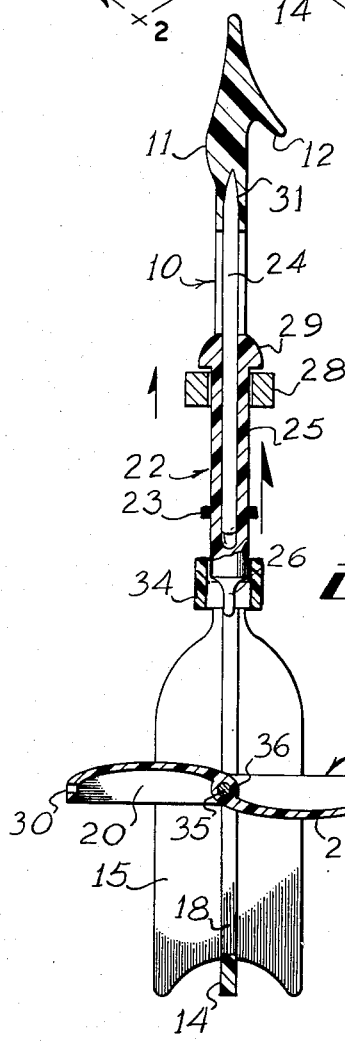

Referring now more particularly to the drawings, and to that embodiment of the invention here presented by way of illustration, it will be seen that the toy shown in FIG. 1 comprises generally a delta wing design, the body 10 constituting an airfoil. At the forward end of the body 10, there is a reinforcing rib 11 extending generally axially on the upper surface of the body 10. Such reinforcing may be needed to provide sufficient strength in the area of the launching hook 12. It will be seen in FIG. 1 that the body 10 is somewhat broken away to show the launching hook 12 extending downwardly from the lower surface of the body 10.

The specific launching apparatus to be used forms no part of the present invention, but those skilled in the art will understand that a simple stick with a rubber band attached can be utilized to launch the device. In this event, the stick can be held in one hand with the rubber band extending between the stick and the launching hook 12 while the opposite hand grips the rearmost edge 14 of the body 10 to stretch the rubber band. When the edge 14 is released, the force of the rubber band will urge the body 10 forward to launch the toy. While this simple arrangement works quite well, it will be equally well understood that sophisticated catapults and the like are well known in the art, and any such arrangement can be successfully utilized with the toy of the present invention.

Looking at the rear section of the body 10 in FIG. 1, it will be seen that there are vertically extending rudders 15 and 16 at each side of the body 10. As is well known in the art, members such as the rudders 15 and 16 provide lateral stability for the toy during flight. While rudders 15 and 16 are here shown as extending both upwardly and downwardly from the plane of the body 10, other arrangements will suggest themselves to those skilled in the art.

Between the rudders 15 and 16, the body 10 includes a generally rectangular opening 18 which receives the rotor generally designated at 19. As will be seen in FIG. 1, the rotor 19 includes a first paddle 20 and a second paddle 21. As viewed in FIG. 1, the paddle 20 is concave, while the paddle 21 is convex. The rotor 19 is arranged to rotate about an axis centered between the paddles 20 and 21, so it will be understood that the rotor 19 will tend to rotate because air will be trapped within the concave side 20 but will flow relatively smoothly over the convex side 21. This will be discussed in more detail below.

As illustrated in FIG. 1, the device is arranged to be launched, or projected into the air. During this launching, the rotor 19 is held in the position shown so the device is sufficiently streamlined to attain a reasonably great maximum height. The means here shown for locking the rotor 19 in position includes the locking means generally indicated at 22. The locking means 22 includes a shank 24 fixed along the longitudinal axis of the body 10. A movable locking member 25 is slidable on the shaft 24, the locking member 25 terminating at its rearmost end in a locking pin 26. Slidably received over the locking member 25, there is a driver 28; and, at the forward end of the locking member 25 there is a head 29.

It will therefore be seen that the locking pin 26 is receivable within a hole 30 in the rotor 19. The locking member 25 is movable forwardly of the body 10 to move the pin 26 from the hole 30 and allow the rotor 19 to rotate. Also, it will be obvious that a bifurcated member can hold the rotor 19 in lieu of the pin 26 and hole 30 here shown.

Figure 2:
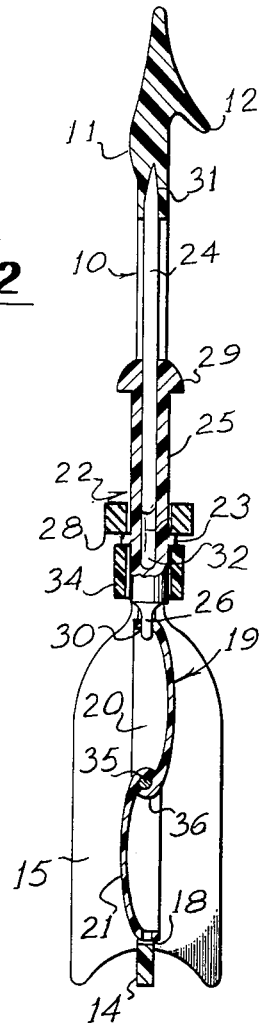
FIG. 2 is a longitudinal cross-sectional view taken substantially along the line 2—2 in FIG. 1 showing the toy in ascending position; and, FIG. 3 is a view similar to FIG. 2 but showing the toy in its descending position.

Attention is next directed to FIG. 2 of the drawings for a better understanding of the construction and operation of the device. FIG. 2 is a longitudinal cross-sectional view taken along the line 2—2 in FIG. 1 and shows the device in condition to be launched, or during ascent. It will be seen that the locking member 25 is rearwardly, or down, so the locking pin 26 is received within the hole 30 in the rotor 19. In this view, it will also be seen that the shank 24 is received within the body 10. Those skilled in the art will understand that the body may be made of any of numerous plastic materials or the like, and the shank 24 may be made of metal in order to have the bend resistance desired. It will of course be understood that plastics such as acrylics, epoxi
for us
Th
body
memb
there
the sh
with
avoid
In
or rea
collar
portic
will
may
factu
is dir
withi
memb
locki
It v
locki
integ
it wil
used.
rearw
that t
interf
shank
Lo
the c
and t
side.
it pas
not lo
seen
35, th
the in
Fr
devic
ing h
move
place
will
proje
strea
heigh
unde
some
of th
the b
air r
forw
force
these
forw
grav
W
3 of
tude
reco
cond
unde
poin
3 it v
head
26 h 2. An aerial toy as claimed in claim 1, said locking means including a locking member carried by said body and reciprocable with respect to said rotor, a driver freely slidable with respect to said locking means, a head at one end of said locking member located for engagement by said driver, means for engaging said rotor at the opposite end of said locking member for locking said rotor, said body being so constructed and arranged that the forward end of said body will point down when said toy begins the descent so that gravity causes said driver to engage said head to move said locking member and release said means for engaging said rotor.

3. An aerial toy as claimed in claim 2, said body defining an opening therein, said rotor being received within said opening for rotation therein, said rotor substantially closing said opening when said rotor is locked against rotation.

4. An aerial toy as claimed in claim 3, said locking means further including a shank carried by said body, said locking member defining a bore therein for slidably receiving said shank, said driver surrounding said locking member and slidable thereon, said means for engaging said rotor comprising a locking pin defined at said opposite end of said locking member.

5. An aerial toy as claimed in claim 4, said body being generally triangular in plan view, and further including a launching hook at a vertex of the triangle, a strengthening rib at said vertex, said longitudinal axis of said body passing through said vertex, said locking means being disposed on said longitudinal axis.

6. An aerial toy as claimed in claim 5, said toy further including rudders extending perpendicularly to said body for providing lateral stability to said toy.

* * * * *